US011167957B1

(12) United States Patent
Striebel et al.

(10) Patent No.: US 11,167,957 B1
(45) Date of Patent: Nov. 9, 2021

(54) SWIVELING HOIST RINGS AND METHODS OF ASSEMBLY

(71) Applicant: Suncor Stainless, Inc., Plymouth, MA (US)

(72) Inventors: Patrick A. Striebel, Duxbury, MA (US); James J. Storrer, Middleboro, MA (US)

(73) Assignee: Suncor Stainless, Inc., Plymouth, MA (US)

( * ) Notice: Subject to any disclaimer, the term of this patent is extended or adjusted under 35 U.S.C. 154(b) by 0 days.

(21) Appl. No.: 17/092,731

(22) Filed: Nov. 9, 2020

(51) Int. Cl.
*B66C 1/66* (2006.01)

(52) U.S. Cl.
CPC ..... *B66C 1/66* (2013.01)

(58) Field of Classification Search
CPC .... B66C 1/66; B25J 15/08; Y10T 403/32213; Y10T 403/32975
USPC ..... 294/215, 89, 82.1; 403/164, 78, 79; 410/101
See application file for complete search history.

(56) References Cited

U.S. PATENT DOCUMENTS 3,492,033 A * 1/1970 Mueller ..... F16C 11/045 294/82.1
4,705,422 A 11/1987 Tsui et al.
4,863,205 A * 9/1989 Schron ..... B66C 1/54 294/89
5,286,130 A 2/1994 Mueller
5,352,056 A 10/1994 Chandler
5,405,210 A 4/1995 Tsui
5,586,801 A 12/1996 Sawyer et al.
5,743,576 A 4/1998 Schron, Jr. et al.
5,823,588 A 10/1998 Morghen
5,848,815 A 12/1998 Tsui et al.
5,927,780 A 7/1999 Chandler
5,979,954 A 11/1999 Tsui et al.
6,017,071 A 1/2000 Morghen
6,022,164 A 2/2000 Tsui et al.
6,161,883 A 12/2000 Pearl
6,161,884 A 12/2000 Pearl
6,349,985 B1 2/2002 Aston
6,398,447 B1 6/2002 Pearl
6,749,237 B1 6/2004 Ma
7,114,872 B2 * 10/2006 Alba ..... F16D 1/12 294/215
8,562,053 B2 * 10/2013 Davidson ..... B66C 1/10 294/215
8,757,693 B2 6/2014 Fuller et al.
10,421,644 B2 9/2019 Losange
10,450,174 B1 10/2019 Kucinic et al.
10,759,633 B2 * 9/2020 Verbrugge ..... F16B 35/06
2004/0032134 A1 * 2/2004 Hageman ..... B66C 1/66 294/215

(Continued)

*Primary Examiner* — Paul T Chin
(74) *Attorney, Agent, or Firm* — Burns & Levinson LLP; John Serio, Esq.; Marlo Schepper Grolnic

(57) ABSTRACT

Swiveling hoist ring assemblies have a single cross pin extending through a housing with an opening for a mounting bolt to pass through both of the cross pin and the housing. The cross pin provides a strong shaft for supporting loads while still permitting axial rotation of the hoist ring assembly. Optional retainers on the end of the cross pin create a tamper-proof assembly. The hoist ring assemblies provide 360 degrees of rotation in the horizontal plane and at least 180 degrees of rotation in the vertical plane about the cross pin axis.

20 Claims, 15 Drawing Sheets

(56) References Cited

U.S. PATENT DOCUMENTS

2006/0055188 A1* 3/2006 Koch ..... B66C 1/108
294/215

* cited by examiner

SWIVELING HOIST RINGS AND METHODS OF ASSEMBLY

FIELD

The present disclosure relates to swiveling hoist ring assemblies for securely mounting to large, heavy structures in need of lifting.

BACKGROUND

A wide variety of hoist devices permit safe lifting of large structures during manufacture or installation, such as aircraft subassemblies, ship hull panels, large machines or machine components. These hoist devices include simple eyebolts, shackles, hoist rings and custom clamps. Selecting and using the proper hoist device for a particular structure requires extreme care, as breakage through misuse or overloading can allow a multi-ton structure to fall, causing damage to the structure and the surrounding area, in addition to potentially causing severe injuries to workers.

Workers typically use simple eye bolts and similar connections for lifting a load lying precisely along the axis of the bolt. However, any side loading of such bolts can result in failure of the bolt. For load directions that vary along a single plane, workers may use a hinged hoist ring to accommodate the changing load direction. However, these hoist rings cannot accommodate loads from any direction other than along the hinging plane. With large, irregularly shaped structures, such as aircraft panels or ship hull panels, workers typically use a fully swiveling hoist ring, having both a rotating base and a hinged ring, to satisfy load and stress requirements from various angles and directions. However, current swiveling hoist rings are often complex and heavy, and require the use of two cross pins that are difficult to assemble, particularly under adverse conditions. Thus, a continuing need exists for swiveling hoist rings that workers can easily replace in the field without special tools or unique, manufacture-specific attachment clips, and that fully support large, fatigue-bending loads.

SUMMARY

The present disclosure describes swiveling hoist ring assemblies having a single cross pin extending through a housing with an opening for a mounting bolt to pass through both of the cross pin and the housing. The cross pin provides a strong shaft for supporting loads while still permitting axial rotation of the hoist ring. The assembly can optionally have additional retainers on the ends of the cross pin to create a strong, tamper proof assembly. Alternatively, the cross-cross pin can have removable clips, or simply no retainers for easy service in the field with typical tools. The hoist ring assemblies of this disclosure provide 360 degrees of rotation in the horizontal plane and at least 180 degrees of rotation in the vertical plane about the cross pin axis. Advantageously, the hoist ring assemblies of this disclosure have a simplified design with a minimum number of parts compared to current hoist ring designs.

In examples, the swiveling hoist ring assemblies of this disclosure include a housing defining a first passage from a first side to an opposing second side of the housing along a longitudinal axis. The housing also defines a second passage from a top surface to a bottom surface of the housing transverse to the longitudinal axis. The first passage intersects the second passage. A bail member has a first end and a second end. The first end defines a first through hole and the second end defines a second through hole. The first end is configured to be coupled to the first side of the housing and the second end is configured to be coupled to the second side of the housing such that the first and second through holes align with first passage. A pin has a shaft defining a channel transverse to the longitudinal axis. The pin is slidable through the first and second through holes of the bail member and through the first passage of the housing such that the channel of the pin aligns with the second passage of the housing. A bolt has a threaded end configured for attachment to a load to be lifted. A shank portion of the bolt is slidable through the second passage of the housing and through the channel of the pin such that the threaded end extends from the bottom surface of the housing. The pin allows rotation of the bail member about the pin.

In further examples, a sleeve member has a flange portion for contacting the load to be lifted, and a cannulated body extending from the flange portion. The cannulated body is slidable through the second passage of the housing and through the channel of the pin from the bottom surface of the housing. The shank portion of the bolt is slidable through the cannulated body from the top surface of the housing such that the threaded end extends from the flange portion. The sleeve member allows rotation of the housing about the sleeve member and the bolt. A length of the cannulated body is selected to be larger than a length of the second passage such that, when the cannulated body slides into the second passage, an end of the cannulated body extends above the top surface of the housing. In examples, an internal diameter of the cannulated body is selected to be larger than an outer diameter of the shank portion of the bolt and an external diameter of the cannulated body is selected to be smaller than an internal diameter of the second passage of the housing. In examples, the assembly further includes a retaining ring secured around the bolt at a mounting surface of the flange portion. In examples, the assembly further includes a washer disposed around the shank portion of the bolt above the top surface of the housing. In examples, the assembly further includes at least one securing member coupled to an end of the pin for retaining the pin within the housing. In other examples, the assembly further includes a mounting base secured around the bolt at the bottom surface of the housing. In examples, the assembly further includes a retaining ring secured around the bolt between the mounting base and the bottom surface of the housing.

Examples of the method of this disclosure include providing a bail member having a first end and a second end. The first end defines a first through hole and the second end defines a second through hole. A housing is provided defining a first passage from a first side to an opposing second side of the housing along a longitudinal axis. The housing defines a second passage from a top surface to a bottom surface of the housing transverse to the longitudinal axis. The first passage intersects the second passage. The bail member is coupled to the housing such that the first and second through holes align with the first passage of the housing. A pin is inserted through the first and second through holes and through the first passage to couple the bail member to the housing. The pin has a shaft defining a channel transverse to the longitudinal axis. The channel of the pin is aligned with the second passage in the housing. A bolt is inserted from the top surface of the housing through the second passage in the housing and through the channel of the pin such that a threaded end of the bolt extends from the bottom surface of the housing.

In further examples, a first securing member is coupled to a first end of the pin for retaining the pin within the housing.

In examples, a second securing member is coupled to a second end of the pin opposite the first end for retaining the pin within the housing. In examples, prior to inserting the bolt through the second passage of the housing, a retaining ring is coupled to a flange portion of a sleeve member. The sleeve member has a cannulated body extending from the flange portion. The cannulated body is inserted into the second passage of the housing from the bottom surface of the housing such that an end of the cannulated body extends above the top surface of the housing. Inserting the bolt through the second passage of the housing includes inserting the bolt through the cannulated body of the sleeve member such that the threaded end extends from the flange portion and the retaining ring couples to a groove on the bolt. In examples, prior to inserting the bolt through the cannulated body, a washer is coupled to the bolt above the top surface of the housing. In other examples, a retaining ring is coupled to a recess in a mounting base and the mounting base is coupled to the bolt at the bottom surface of the housing. The retaining ring translates bolt tightening torque to the recess, allowing the housing to freely rotate about the bolt.

Further examples of the swiveling hoist assembly of this disclosure include a bail member having a first end and a second end. The first end defines a first through hole and the second end defines a second through hole. The first and second through holes define a passage along a longitudinal axis. A pin has a shaft defining a channel transverse to the longitudinal axis. The pin is slidable through the first and second through holes of the bail member and through the first passage such that the channel is disposed between the first and second ends of the bail member. A bolt has a threaded end configured for attachment to a load to be lifted. A shank portion of the bolt is slidable through the channel of the pin from a top surface of the pin. A sleeve member has a flange portion for contacting the load to be lifted, and a cannulated body extending from the flange portion. The cannulated body is slidable through the channel of the pin from a bottom surface of the pin. The shank portion of the bolt is slidable through the cannulated body such that the threaded end extends from the flange portion. The sleeve member allows rotation of the pin about the sleeve member and the bolt, and the pin allows rotation of the bail member about the pin. In further examples, a washer is disposed around the shank portion of the bolt and housed within a counterbore at the top surface of the pin.

Further examples of the method of this disclosure include providing a bail member having a first end and a second end. The first end defines a first through hole and the second end defines a second through hole. The first and second through holes define a passage along a longitudinal axis. A pin in inserted through the first and second through holes and through the first passage to couple the bail member to the pin. The pin has a shaft defining a channel transverse to the longitudinal axis. The channel of the pin is aligned between the first and second ends of the bail member. A bolt is inserted from the top surface of the pin through the channel of the pin such that a threaded end of the bolt extends from the bottom surface of the pin.

In further examples, a sleeve member is provided having a flange portion and a cannulated body extending from the flange portion. Prior to inserting the bolt through the channel of the pin, the cannulated body of the sleeve member is inserted into the channel of the pin from the bottom surface pin. Inserting the bolt through channel of the pin includes inserting the bolt through the cannulated body of the sleeve member such that the threaded end extends from the flange portion. In yet further examples, prior to inserting the bolt through the cannulated body, a washer is coupled to the shank portion of the bolt. The washer is configured to be housed within a counterbore at the top surface of the pin.

A reading of the following detailed description and a review of the associated drawings will make apparent the advantages of these and other features. Both the foregoing general description and the following detailed description serve to explain the disclosure only and do not restrict aspects of the disclosure as claimed.

BRIEF DESCRIPTION OF THE DRAWINGS

Reference to the detailed description, in conjunction with the following figures, will make the disclosure more fully understood, wherein.

DETAILED DESCRIPTION

Figure 1A:
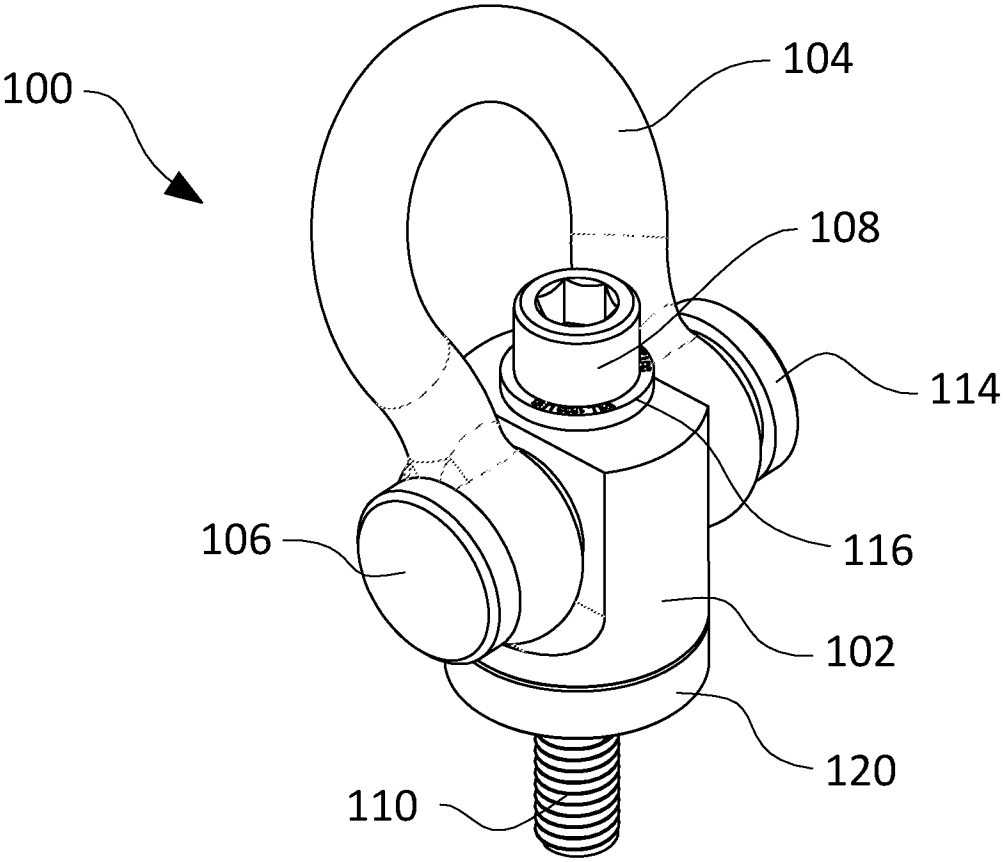
FIGS. 1A and 1B illustrate an example of the swiveling hoist ring assembly of this disclosure in a perspective view (FIG. 1A) and a cross-sectional view (FIG. 1B)

In the description that follows, like components have the same reference numerals, regardless of whether they present in different examples. To illustrate examples in a clear and concise manner, the drawings may not necessarily illustrate scale and may show certain features in somewhat schematic form. Features described and/or illustrated with respect to one example may exist in the same way or in a similar way in one or more other examples and/or in combination with or instead of the features of the other examples.

As used in the specification and claims, for the purposes of describing and defining the invention, the terms "about" and "substantially" represent the inherent degree of uncertainty attributed to any quantitative comparison, value, measurement, or other representation. The terms "about" and "substantially" also represent the degree by which a quantitative representation may vary from a stated reference without resulting in a change in the basic function of the subject matter at issue. "Comprise," "include," and/or plural forms of each include the listed parts and can include additional parts not listed. "And/or" includes one or more of the listed parts and combinations of the listed parts. The terms "upper," "lower," "above," "below," and the like serve to clearly describe the disclosure but do not limit the structure, positioning and/or operation of the disclosure in any manner.

Figure 1B:
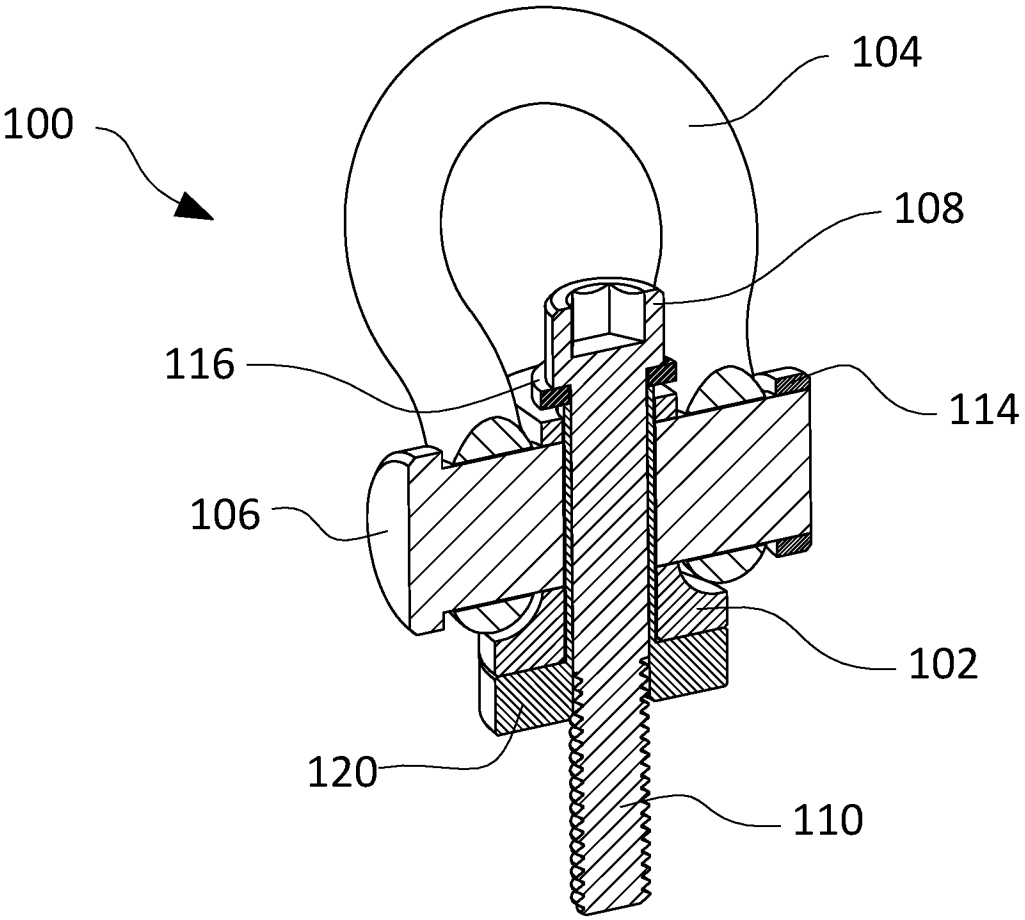

FIGS. 1A and 1B illustrate an example of a swiveling hoist ring assembly 100 of this disclosure in a perspective view (FIG. 1A) and a cross-sectional view (FIG. 1B). The assembly 100 generally comprises a housing 102, a bail member 104, a cross pin 106, a bolt 108 having a threaded end 110, an optional cap ring 114, a washer 116, and an optional sleeve 120, each described in more detail below. Once mounted to an object to be lifted, the assembly 100 allows the object to freely rotate at least 180 degrees in a vertical plane and 360 degrees in a horizontal plane in a self-aligning method to keep the plane of the bail member 104 in line with the lifting load.

In examples, component parts of the assembly 100 may comprise "austenitic" 300 series stainless steel, such as 316 stainless steel. In other examples, component parts of the assembly 100 may comprise 17-4 PH stainless steel, which has a higher strength potential than 316 stainless steel. In yet further examples, component parts of the assembly 100 may comprise Nitronic 50 stainless steel, which has both a higher strength potential and better corrosion resistance than either 316 or 17-4 PH stainless steel. The disclosure also contemplates that component parts of the assembly 100 could comprise other types of stainless steel, such as "martensitic" 400, which can be hardened, or carbon steels. In examples, the bail member 104 may be forged, while other component parts of the assembly 100 may be machined.

Figure 1C:
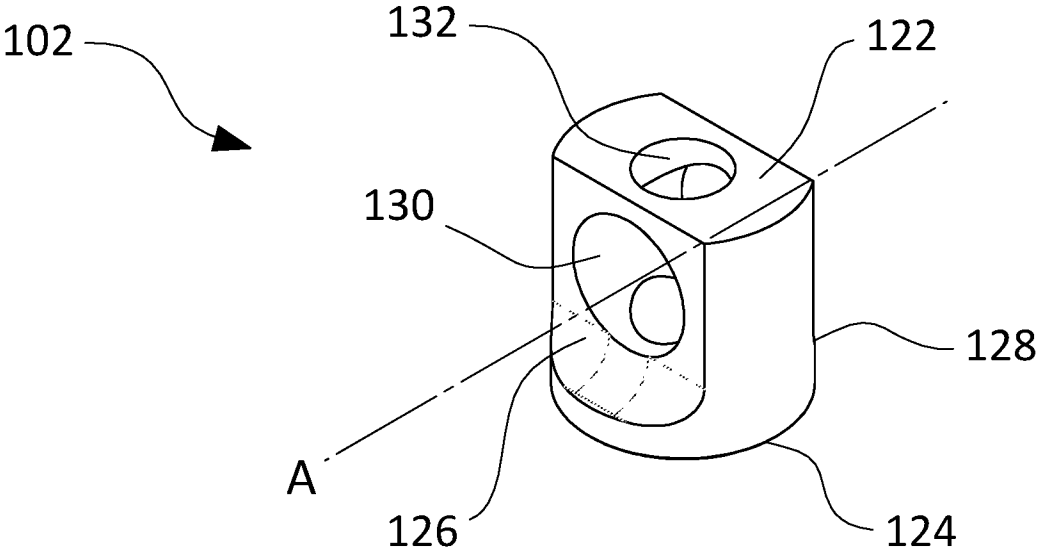
FIGS. 1C-G illustrate details of the component parts of the swiveling hoist ring assembly of FIGS. 1A and 1B.

Turning now to FIG. 1C, examples of the housing 102 have a top surface 122, a bottom surface 124, a first side 126 and a second side 128 opposite the first side 126. The first and second sides 126, 128 may have a substantially flat surface. The housing 102 defines a first passage 130 from the first side 126 to the second side 128 along a longitudinal axis A. The housing also defines a second passage 132 from the top surface 122 to the bottom surface 124 transverse to the longitudinal axis A, such that the first passage 130 intersects the second passage 132.

Figure 1D:
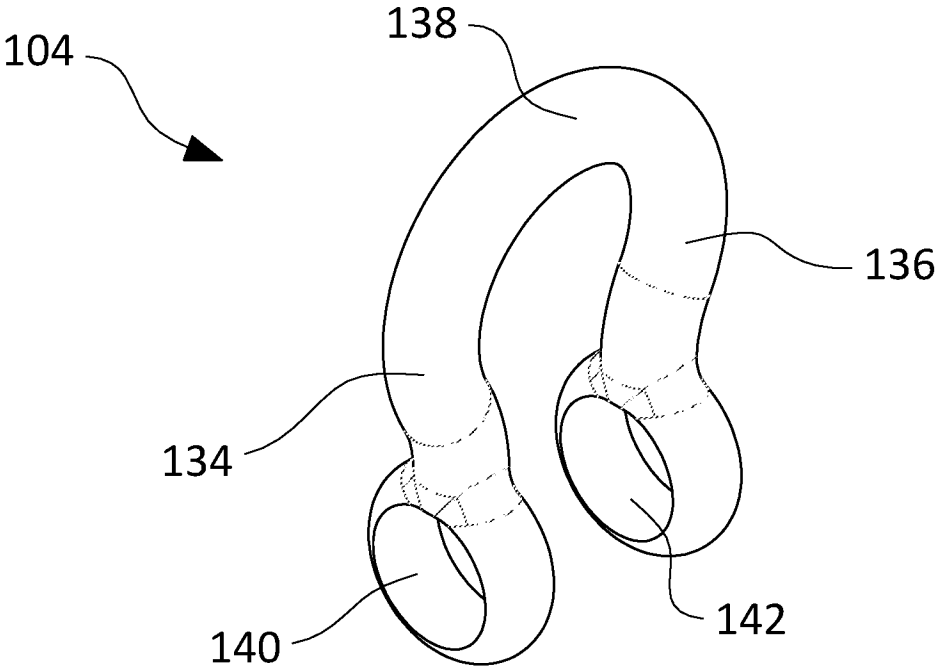

As shown in FIG. 1D, examples of the bail member 104 (for example, an anchor-shaped shackle bail) have a first leg 134, a second leg 136, and a u-shaped bend 138 joining the first and second legs 134, 136 for attachment to a lifting line. In other examples, not shown, the bail member 104 may have a shape other than a u-shape. The bail member 104 may also be a chain shackle. An end of the first leg 134 defines a first through hole 140, while and an end of the second leg 136 defines a second through hole 142. The first leg 134 couples to the first side 126 of the housing 102 and the second leg 136 couples to the second side 128 of the housing 102 such that the first and second through holes 140, 142 align with first passage 130.

Figure 1E:
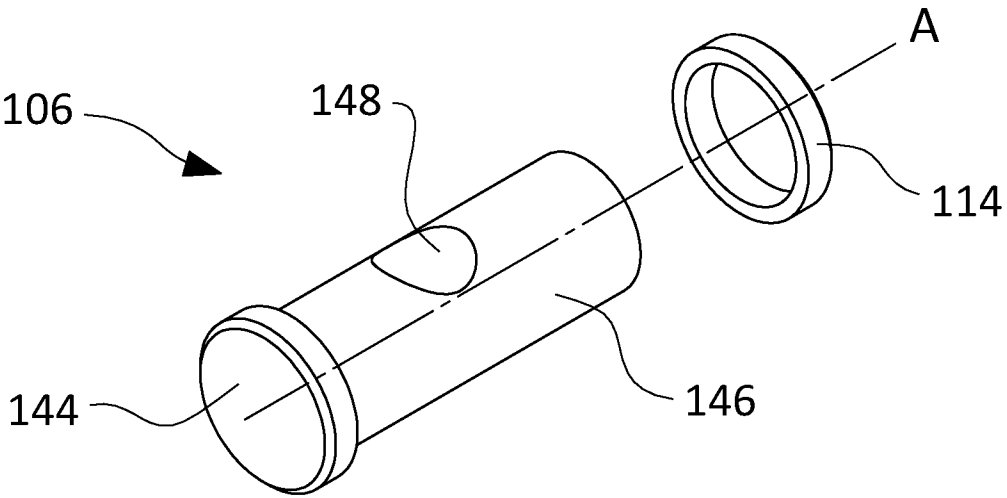

Turning now to FIG. 1E, examples of the cross pin 106 (for example, a clevis pin) may have a head portion 144 and a cylindrical shaft 146 extending from the head portion 144. The cross pin 106 may comprise stainless steel or other suitable materials, and may have a diameter significantly larger than cross pins used in current hoist ring designs. The shaft 146 defines a channel 148 extending through the shaft 146 transverse to the longitudinal axis A. The cross pin 106 slides through the first and second through holes 140, 142 of the bail member 104 and through the first passage 130 of the housing 102 such that the channel 148 aligns with the second passage 132 of the housing 102. The cross pin 106 couples the bail member 104 to the housing 102 such that the bail member 104 pivots about the cross pin 106 at least 180 degrees. In the example of the assembly 100, a cap ring 114 optionally welded to the end of the shaft 146 creates a tamper-proof assembly.

Figure 1F:
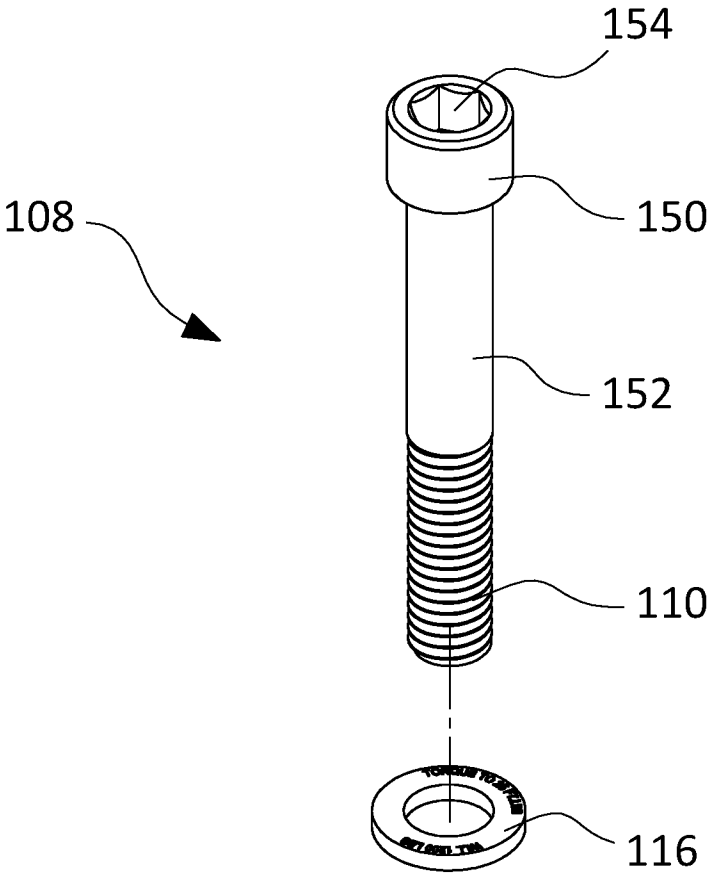

As shown in FIG. 1F, examples of the bolt 108 may include commercially-available, stainless steel socket-head cap screws. The bolt 108 may have a head portion 150 and a cylindrical shank 152 extending from the head portion 150. In examples, the head portion 150 has an opening 154 adapted to couple to an insertion tool. An end 110 of the bolt 108 opposite the head portion 150 has threads for attachment to tapped hole in a mounting surface of an object to be lifted (not shown). The bolt 108 slides through the second passage 132 of the housing 102 and through the channel 148 of the cross pin 106 such that the threaded end 110 extends from the bottom surface 124 of the housing 102. The washer 116 fits around the shank 152 between the head portion 150 and the top surface 122 of the housing. In examples, the washer 116 is a thrust wear washer comprising an oil impregnated bronze or equivalent material to support thrust load and to reduce friction and wear during use.

Figure 1G:
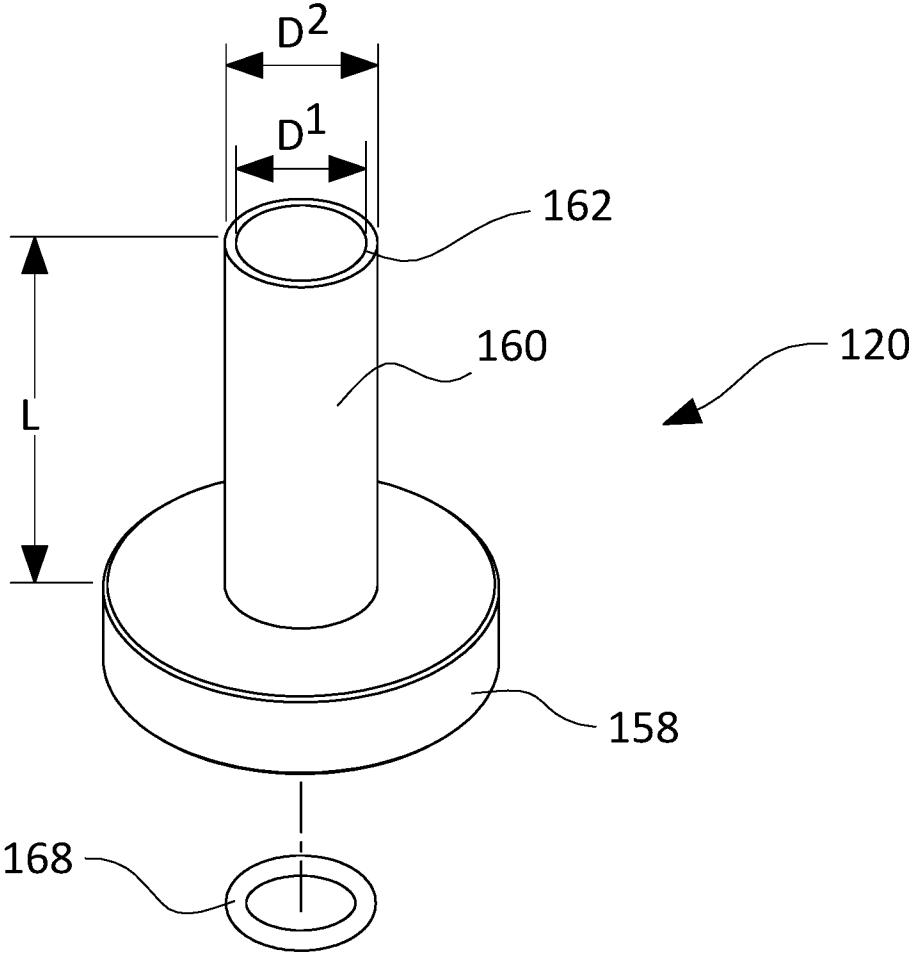
Figure 1H:
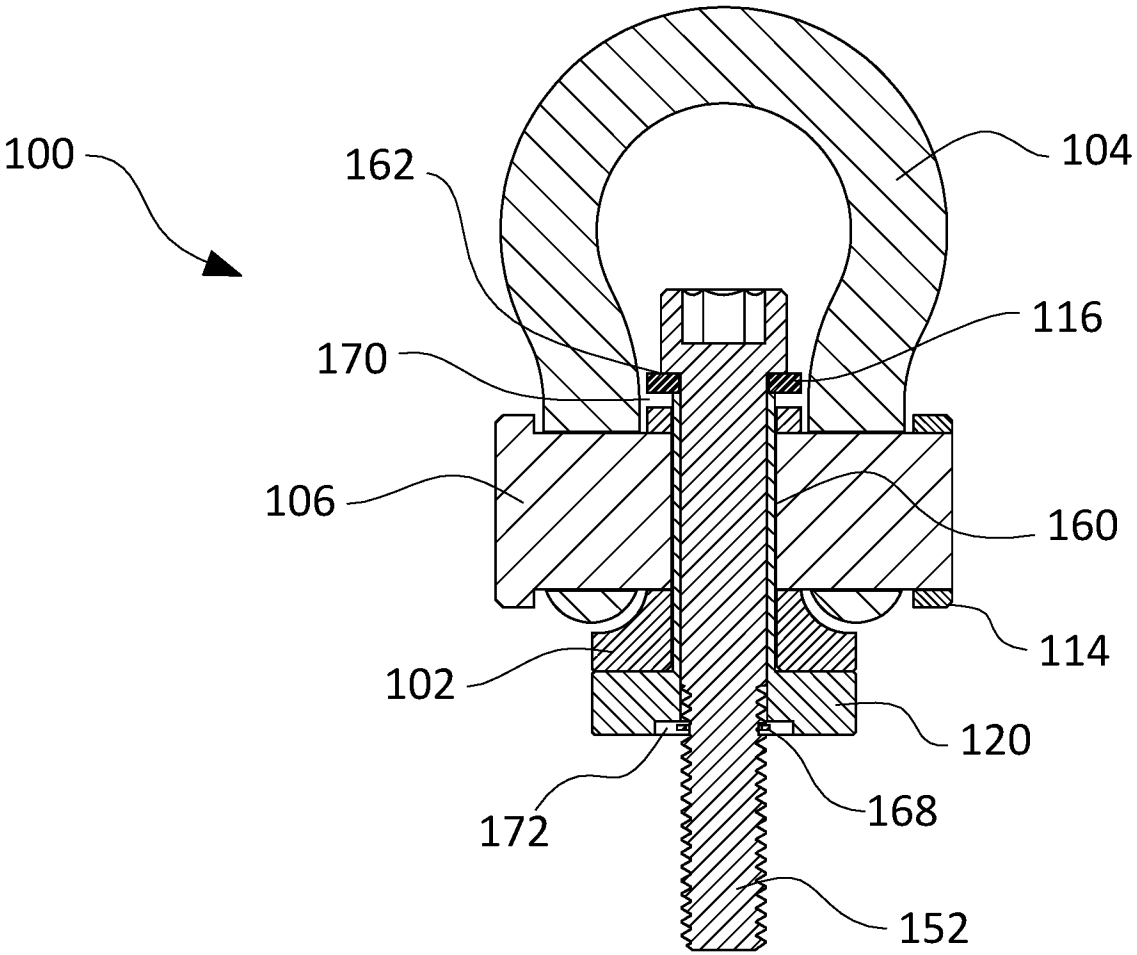
FIG. 1H illustrates another cross-sectional view of the swiveling hoist ring assembly of FIGS. 1A and 1B.

Turning now to FIG. 1G, examples of the sleeve 120 may have a flange 158 and a cannulated body 160 extending from the flange 158. The flange 158 rests against the mounting surface of the object to be lifted. Examples of the sleeve 120 comprise stainless steel or other suitable materials. An internal diameter $D^1$ of the cannulated body 160 is selected to be larger than an outer diameter of the shank 152 of the bolt 108, while an external diameter $D^2$ of the cannulated body 160 is selected to be smaller than an internal diameter of the second passage 132 of the housing 102. Thus, the cannulated body 160 slides into the second passage 132 of the housing 102 from the bottom surface 124 of the housing 102 while allowing the shank 152 of the bolt 108 to slide through the cannulated body 160 from the top surface 122 of the housing 102. A length L of the cannulated body 160 is selected to be larger than a length of the second passage 132 such that, when the cannulated body 160 slides into the second passage 132, an end 162 of the cannulated body 160 extends above the top surface 122 of the housing, thus providing clearance area 170 for the washer 116 (FIG. 1H). The clearance area 170 also allows the housing 102 to freely rotate 360 degrees about the bolt 108 and the sleeve 120. Additionally, the sleeve 120 provides axial support perpendicular to the mounting surface for the housing 102. A retaining ring 168 (for example, an O-ring or a snap-ring) fits into a groove in the shank 152 of the bolt 108 to keep the assembly 100 together when not in use. The sleeve 120 includes a recessed pocket 172 for receipt of the retaining ring 168 at the mounting surface of the flange 150. The disclosure also contemplates that the housing 102 could incorporate a retaining ring so that the assembly 100 becomes an integral one-piece unit when not in use. In other examples, not shown, the rotational swiveling load is supported by ball bearings, lubricated low friction metal or composite thrust washers, or combinations of both.

Figure 1I:
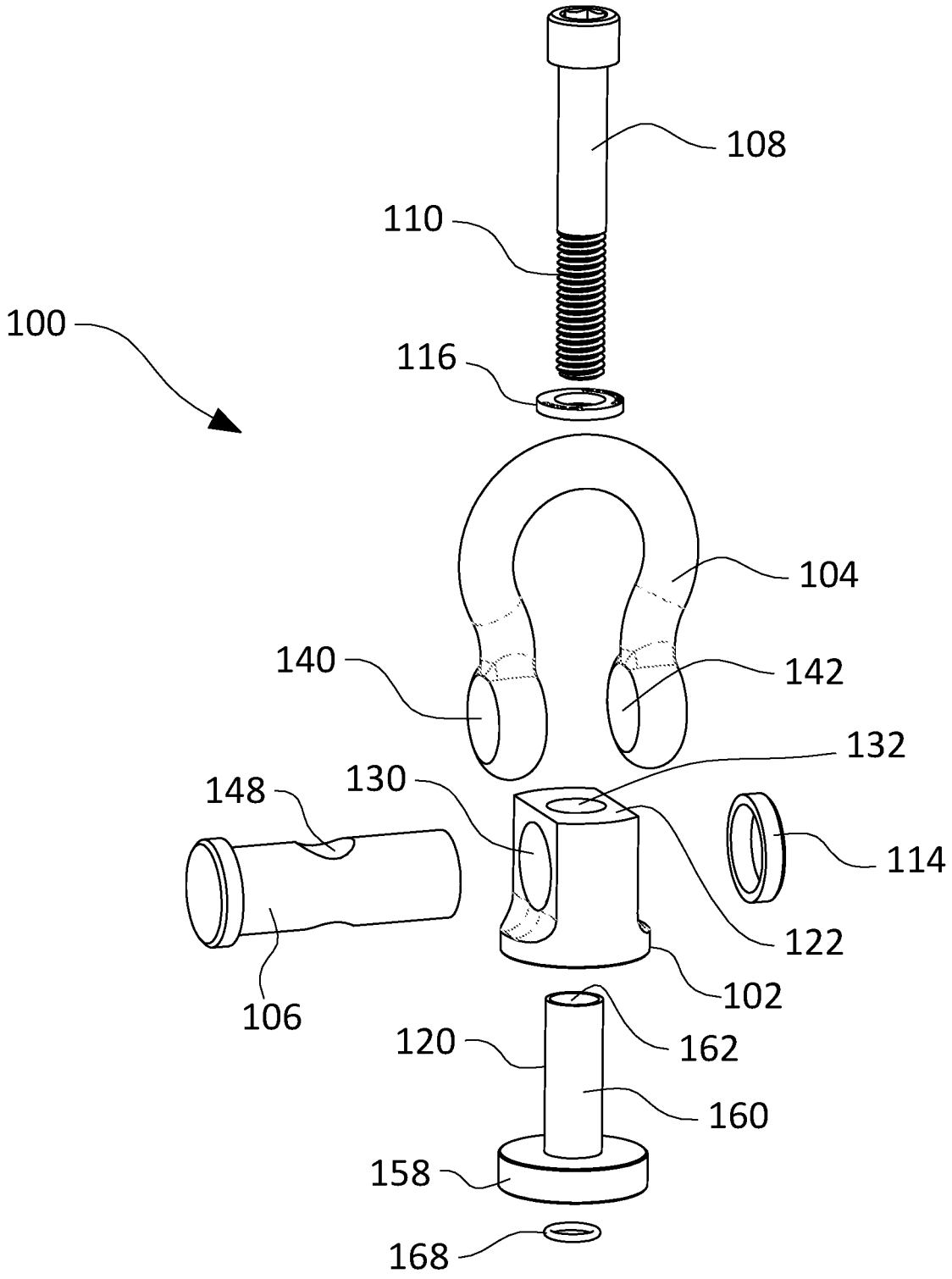
FIG. 1I illustrates a method of assembling the swiveling hoist ring assembly of FIGS. 1A and 1B.

FIG. 1I illustrates a non-limiting example of assembling the swiveling hoist ring assembly 100 of this disclosure. Initially, the bail member 104 is fitted to the housing 102 such that the first and second through holes 140, 142 align with the first passage 130 of the housing 102. The cross pin 106 is then inserted through the first and second through holes 140, 142 and through the first passage 130 to couple the bail member 104 to the housing 102. In examples, the cap ring 114 can be assembled to the cross-pin 106 to secure the cross pin 106 within the housing 102. The cross pin 106 is rotated until the channel 148 in the cross pin 106 aligns with the second passage 132 in the housing 102. The cannulated body 160 of the sleeve 120 is inserted into the second passage 132 of the housing 102 such that the end 162 of the sleeve 120 extends above the top surface 122 of the housing 102. Next, the washer 116 is placed around the shank 152 of the bolt 108 at the top surface 122 of the housing 102. The bail member 104 can then be rotated out of the way so that the bolt 108 can be inserted through the cannulated body 160 of the sleeve 120 such that the threaded end 110 extends from the flange 158 and the washer 116 is disposed above the end 162 of the cannulated body 160. Finally, the retaining ring 168 is fitted into the flange 158 of the sleeve 120 and into a groove on the bolt 108 to secure the assembly 100 together until use. In other examples, not shown, a flexible o-ring could be used instead of the retaining ring 168, eliminating the need for a groove on the bolt 108 or a recessed pocket in the flange 158. In yet other examples, not shown, a grease fitting could be inserted through the second passage 132 of the housing 102 to lubricate the bolt 108 and/or the sleeve 120 prior to insertion through the housing 102.

Figures 2A, 2B:
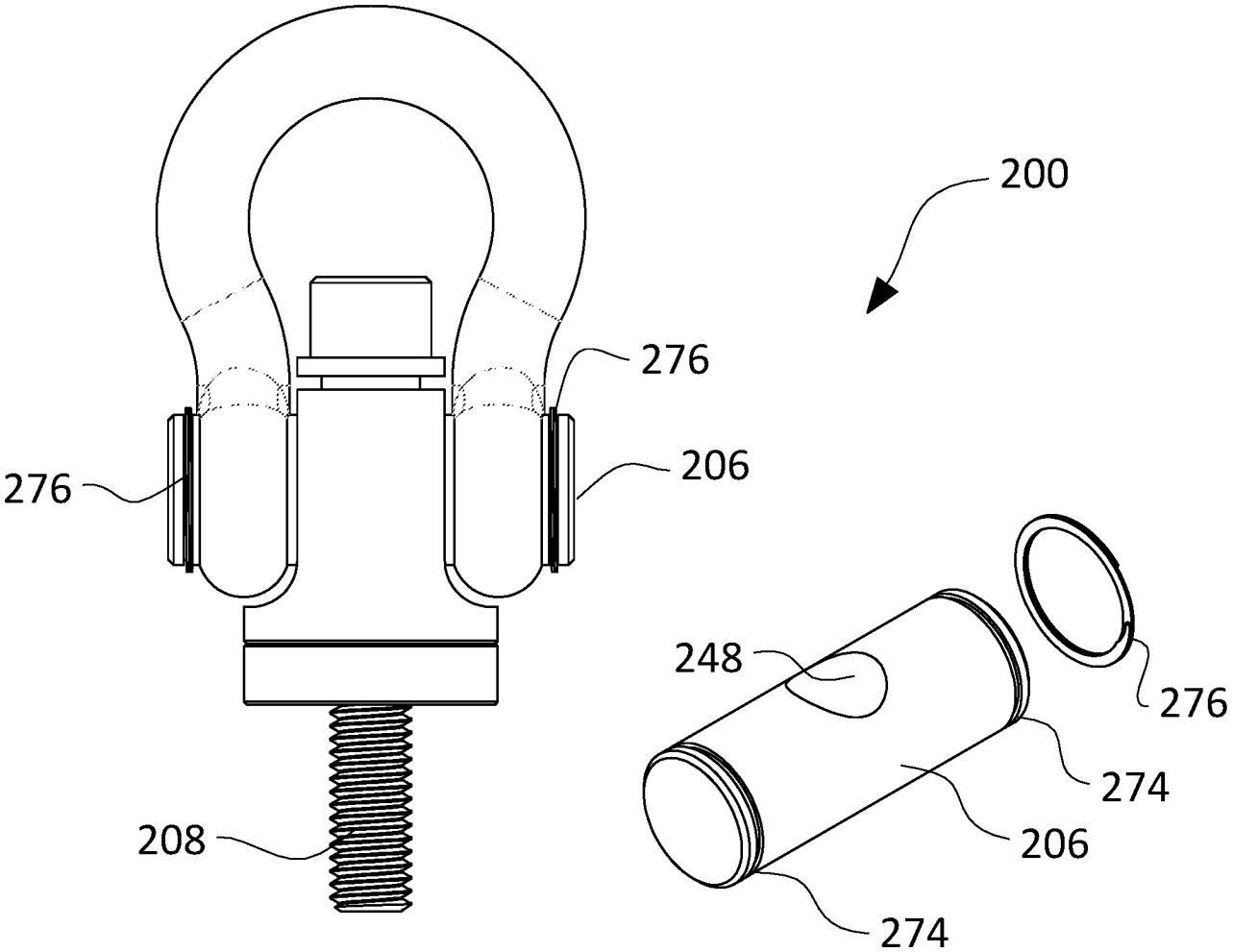
FIGS. 2A and 2B illustrate a second example of the swiveling hoist ring assembly of this disclosure in an assembled view (FIG. 2A) and a detailed view (FIG. 2B)

FIGS. 2A and 2B show another example of the swiveling hoist ring assembly 200 of this disclosure. The assembly 200 substantially replicates the assembly 100 except as described below. Like the cross pin 106 of the assembly 100, the cross pin 206 of the assembly 200 defines a channel 248 for passage of the bolt 208. However, in the example of FIGS. 2A and 2B, the cross pin 206 does not include head portion. Instead, a surface of the cross pin 206 at opposing ends defines grooves 274 machined into the cross-pin 206 for receipt of heavy-duty retaining rings 276 which can be installed into and removed from the grooves 274 using standard tools. The retaining rings 276 secure the cross pin 206 within the housing 202 of the assembly 200. The disclosure also contemplates other suitable methods for securing the cross pin 106, 206 within the housing 102, 202, such as bolts, nuts and cotter pins (not shown).

Figure 3:
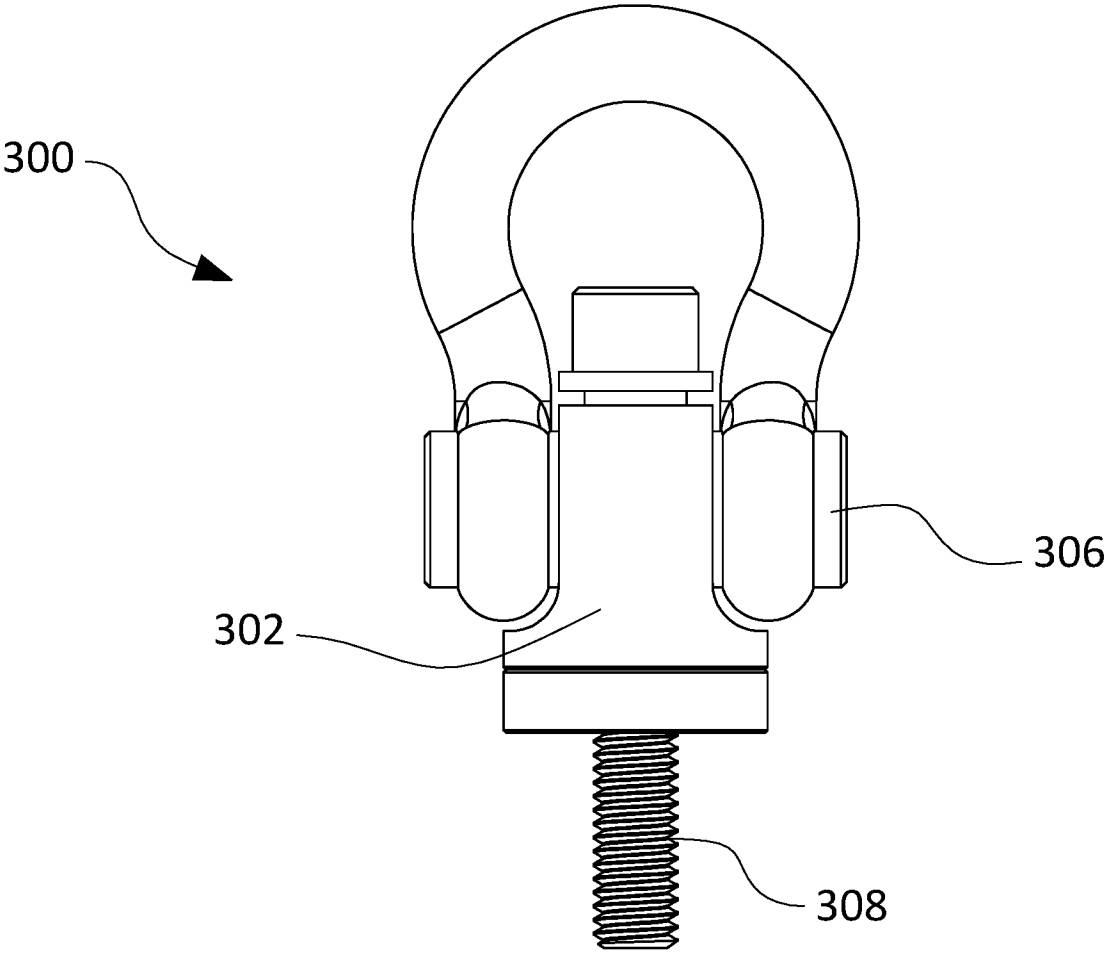
FIG. 3 illustrates a third example of the swiveling hoist ring assembly of this disclosure in an assembled view.

FIG. 3 shows another example of the swiveling hoist ring assembly 300 of this disclosure. The assembly 300 substantially replicates the assembly 100 except as described below. In the example of FIG. 3, the cross pin 306 comprises a straight pin without any retaining methods on either end. Instead, the cross pin 306 is held in place within the housing 302 by the action of the bolt 308 extending through the cross pin 306. The assembly 300 advantageously provides a serviceable design that does not require the use of special tools to service or replace parts of the assembly 300 in the field.

Figure 4:
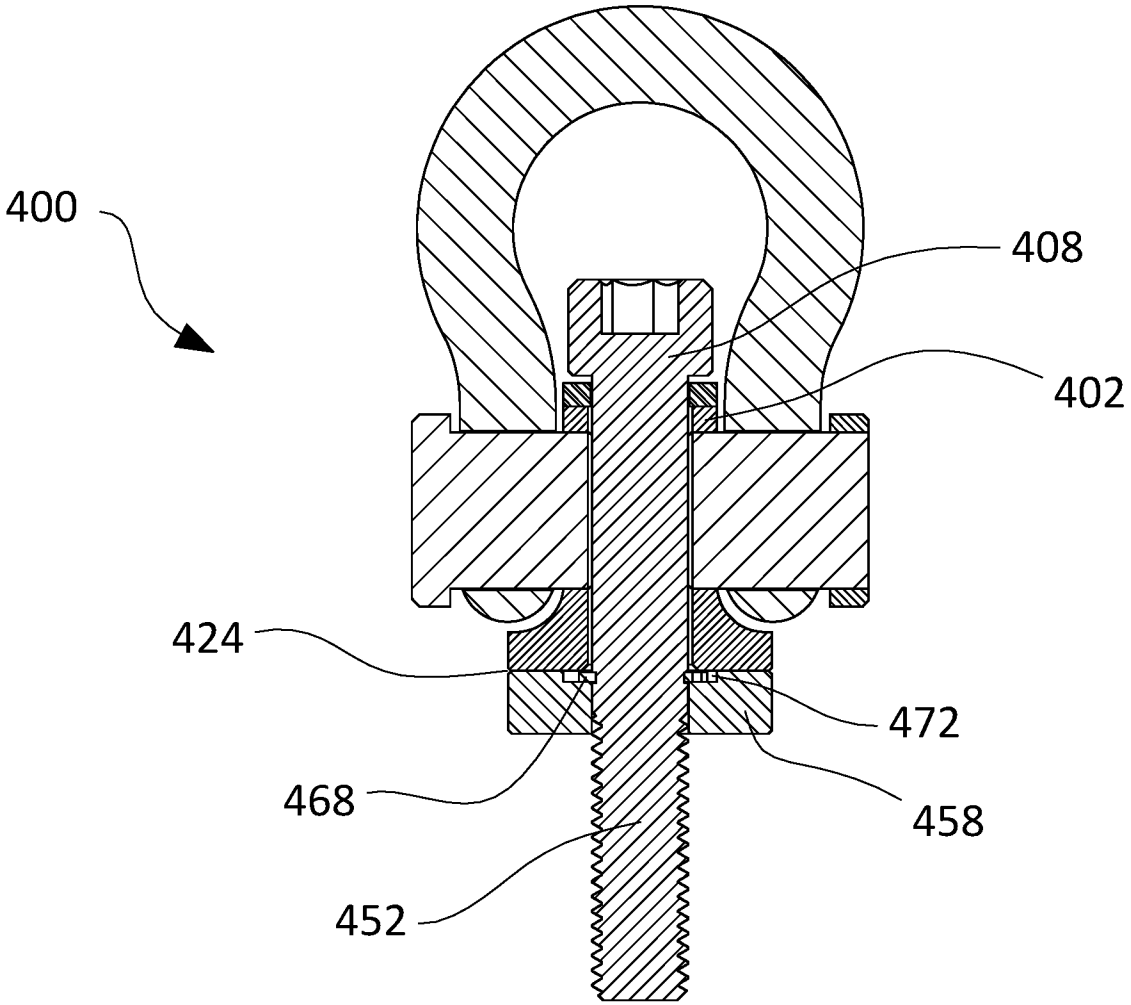
FIG. 4 illustrates a fourth example of the swiveling hoist ring assembly of this disclosure in a cross-sectional view.

FIG. 4 shows another example of the swiveling hoist ring assembly 400 of this disclosure. The assembly 400 substantially replicates the assembly 100 except as described below. In the assembly 400, the sleeve may be replaced by a mounting base 458 in the form of a threaded or unthreaded component, allowing for a larger-sized bolt 408 to pass through the housing 402 and through an opening in the mounting base 458. The retaining ring 468 may be placed within a recessed pocket 472 of the mounting base 458 prior to assembly. The mounting base 458 is secured to the shank 452 of the bolt 408 such that the retaining ring 468 fits into a groove on the shank 452. In this example, the retaining ring 468 translates the torque of tightening the bolt 408 to the recess 472, allowing the housing 402 to freely rotate about the shank 452 of the bolt 408.

Figure 5A:
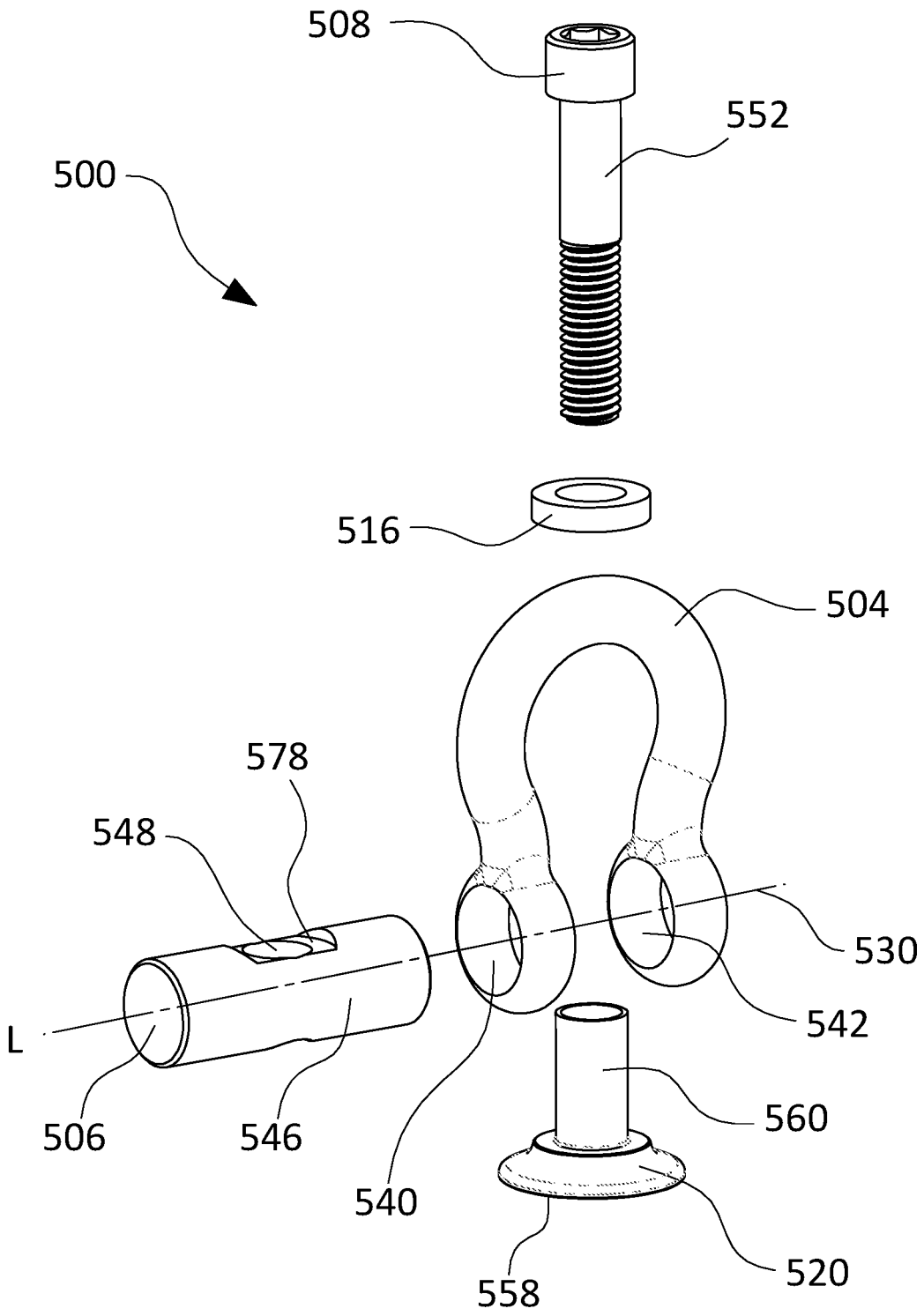
FIGS. 5A-C illustrate a fifth example of the swiveling hoist ring assembly of this disclosure in in an exploded view (FIG. 5A), an assembled view (FIG. 5B) and a cross-sectional view (FIG. 5C).
Figure 5B:
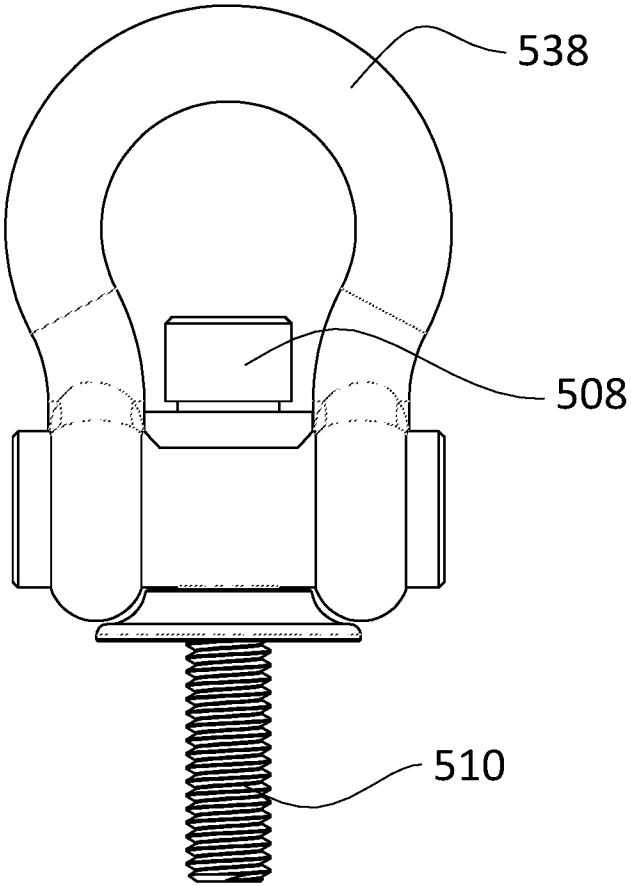
Figure 5C:
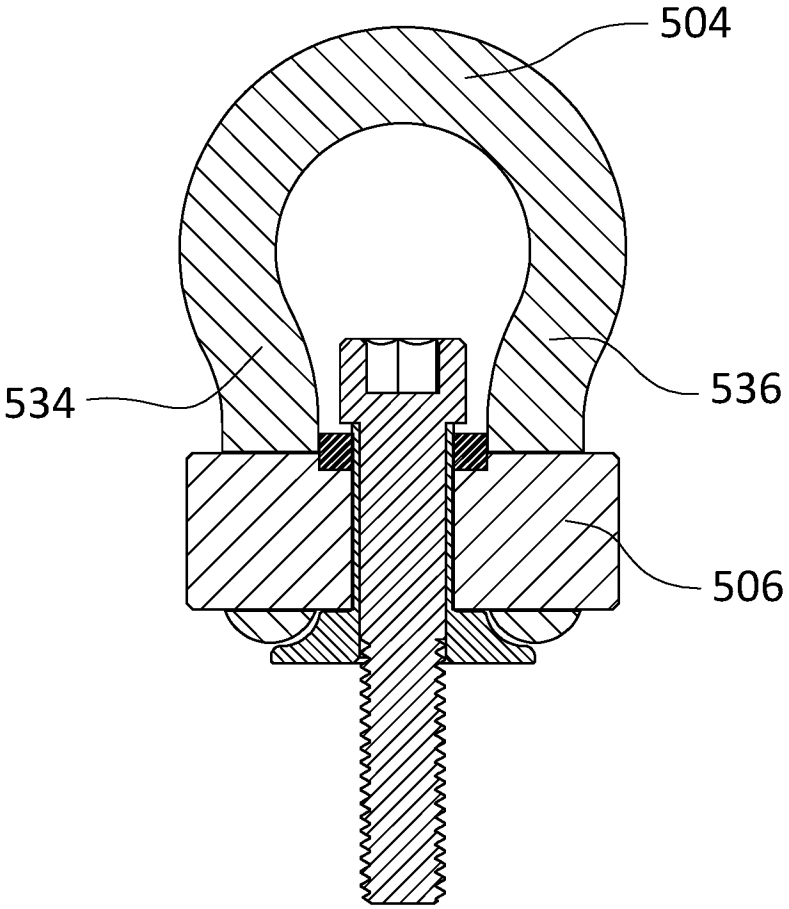

FIGS. 5A-C show yet another example of the swiveling hoist ring assembly 500 of this disclosure in an exploded view (FIG. 5A), an assembled view (FIG. 5B) and a cross-sectional view (FIG. 5C). The assembly 500 substantially replicates the assembly 100 except as described below. In the assembly 500, the cross pin 506 serves as both a housing and a support member for the passage of the bolt 508. In the example of FIGS. 5A-C, the bail member 504 has a first end 534, a second end 536 and a u-shaped bend 538 extending between the first and second ends 534, 536. The first end 534 defines a first through hole 540 and the second end 536 defines a second through hole 542. The first and second through holes 540, 542 define a passage 530 along a longitudinal axis L. The cross pin 506 has a shaft 546 defining a channel 548 transverse to the longitudinal axis L. The cross pin 506 slides through the first and second through holes 540, 542 of the bail member 504 and through the first passage 530 such that the channel 548 is disposed between the first and second ends 534, 536 of the bail member 504. The bolt 508 has a threaded end 510 configured for attachment to a load to be lifted. The shank portion 552 of the bolt 508 slides through the channel 548 of the cross pin 506 from a top surface of the cross pin 506. The sleeve member 520 has a flange portion 558 for contacting the load to be lifted, and a cannulated body 560 extending from the flange portion 558. The cannulated body 560 slides through the channel 548 of the cross pin 506 from a bottom surface of the cross pin 506. The shank portion 552 of the bolt 508 slides through the cannulated body 560 such that the threaded end 510 extends from the flange portion 520. The washer 516 seats into a recessed counterbore 578 on the top surface of the cross pin 506 to keep the assembly 500 centered. The sleeve member 520 allows rotation of the cross pin 506 about the sleeve member 520 and the bolt 508, while the cross pin 506 allows rotation of the bail member 504 about the cross pin 506.

Examples of the hoist ring assemblies 100, 200, 300, 400, 500 could be pre-installed on a threaded stud mounted on an object to be lifted (such as concrete). In this case, the threaded stud would extend through the second passage of the housing and be secured with a nut threaded on the stud at a top surface of the housing. In other examples, the hoist ring assemblies 100, 200, 300, 400, 500 could be provided to a user without the bail member 104 so that the user could install their own custom shackle or bail.

One skilled in the art will realize the disclosure may embody other specific forms without departing from the spirit or essential characteristics thereof. The foregoing examples in all respects illustrate rather than limit the disclosure described herein. The appended claims, rather than the foregoing description, thus indicate the scope of the disclosure, and embrace all changes that come within the meaning and range of equivalency of the claims.

What is claimed is:

1. A swiveling hoist ring assembly comprising:

a housing defining a first passage from a first side to an opposing second side of the housing along a longitudinal axis, and defining a second passage from a top surface to a bottom surface of the housing transverse to the longitudinal axis, the first passage intersecting the second passage;

a bail member having a first end and a second end, the first end defining a first through hole and the second end defining a second through hole, the first end configured to be coupled to the first side of the housing and the second end configured to be coupled to the second side of the housing such that the first and second through holes align with first passage;

a pin having a shaft defining a channel transverse to the longitudinal axis, the pin slidable through the first and second through holes of the bail member and through the first passage of the housing such that the channel of the pin aligns with the second passage of the housing;

a bolt having a threaded end configured for attachment to a load to be lifted, a shank portion of the bolt slidable through the second passage of the housing and through the channel of the pin such that the threaded end extends from the bottom surface of the housing;

wherein the pin allows rotation of the bail member about the pin.

2. The assembly of claim 1, further comprising:

a sleeve member having a flange portion for contacting the load to be lifted, and a cannulated body extending from the flange portion, the cannulated body slidable through the second passage of the housing and through the channel of the pin from the bottom surface of the housing;

wherein the shank portion of the bolt is slidable through the cannulated body from the top surface of the housing such that the threaded end extends from the flange portion; and wherein the sleeve member allows rotation of the housing about the sleeve member and the bolt.

3. The assembly of claim 2, wherein a length of the cannulated body is selected to be larger than a length of the second passage such that, when the cannulated body slides into the second passage, an end of the cannulated body extends above the top surface of the housing.

4. The assembly of claim 2, wherein an internal diameter of the cannulated body is selected to be larger than an outer diameter of the shank portion of the bolt, and an external diameter of the cannulated body is selected to be smaller than an internal diameter of the second passage of the housing.

5. The assembly of claim 2, further comprising a retaining ring secured around the bolt at a mounting surface of the flange portion.

6. The assembly of claim 2, further comprising a washer disposed around the shank portion of the bolt above the top surface of the housing.

7. The assembly of claim 1, further comprising at least one securing member coupled to an end of the pin for retaining the pin within the housing.

8. The assembly of claim 1, further comprising a mounting base secured around the bolt at the bottom surface of the housing.

9. The assembly of claim 8, further comprising a retaining ring secured around the bolt between the mounting base and the bottom surface of the housing.

10. A method of assembling a swiveling hoist ring, the method comprising:

providing a bail member having a first end and a second end, the first end defining a first through hole and the second end defining a second through hole;

providing a housing defining a first passage from a first side to an opposing second side of the housing along a longitudinal axis, and defining a second passage from a top surface to a bottom surface of the housing transverse to the longitudinal axis, the first passage intersecting the second passage;

coupling the bail member to the housing such that the first and second through holes align with the first passage of the housing;

inserting a pin through the first and second through holes and through the first passage to couple the bail member to the housing, the pin having a shaft defining a channel transverse to the longitudinal axis;

aligning the channel of the pin with the second passage in the housing; and inserting a bolt from the top surface of the housing through the second passage in the housing and through the channel of the pin such that a threaded end of the bolt extends from the bottom surface of the housing.

11. The method of claim 10, further comprising coupling a first securing member to a first end of the pin for retaining the pin within the housing.

12. The method of claim 11, further comprising coupling a second securing member to a second end of the pin opposite the first end for retaining the pin within the housing.

13. The method of claim 10, further comprising:

prior to inserting the bolt through the second passage of the housing, coupling a retaining ring to a flange portion of a sleeve member, the sleeve member having a cannulated body extending from the flange portion; and inserting the cannulated body into the second passage of the housing from the bottom surface of the housing such that an end of the cannulated body extends above the top surface of the housing;

wherein inserting the bolt through the second passage of the housing comprises inserting the bolt through the cannulated body of the sleeve member such that the threaded end extends from the flange portion and the retaining ring couples to a groove on the bolt.

14. The method of claim 13, further comprising:

prior to inserting the bolt through the cannulated body, coupling a washer to the bolt above the top surface of the housing.

15. The method of claim 10, further comprising:

coupling a retaining ring to a recess in a mounting base; and coupling the mounting base to the bolt at the bottom surface of the housing;

wherein the retaining ring translates bolt tightening torque to the recess, allowing the housing to freely rotate about the bolt.

16. A swiveling hoist ring assembly comprising:

a bail member having a first end and a second end, the first end defining a first through hole and the second end defining a second through hole, the first and second through holes defining a passage along a longitudinal axis;

a pin having a shaft defining a channel transverse to the longitudinal axis, the pin slidable through the first and second through holes of the bail member and through the first passage such that the channel is disposed between the first and second ends of the bail member;

a bolt having a threaded end configured for attachment to a load to be lifted, a shank portion of the bolt slidable through the channel of the pin from a top surface of the pin;

a sleeve member having a flange portion for contacting the load to be lifted, and a cannulated body extending from the flange portion, the cannulated body slidable through the channel of the pin from a bottom surface of the pin;

wherein the shank portion of the bolt is slidable through the cannulated body such that the threaded end extends from the flange portion; and wherein the sleeve member allows rotation of the pin about the sleeve member and the bolt, and the pin allows rotation of the bail member about the pin.

17. The assembly of claim 16, further comprising a washer disposed around the shank portion of the bolt and housed within a counterbore at the top surface of the pin.

18. A method of assembling a swiveling hoist ring, the method comprising:

providing a bail member having a first end and a second end, the first end defining a first through hole and the second end defining a second through hole, the first and second through holes defining a passage along a longitudinal axis;

inserting a pin through the first and second through holes and through the first passage to couple the bail member to the pin, the pin having a shaft defining a channel transverse to the longitudinal axis;

aligning the channel of the pin between the first and second ends of the bail member; and inserting a bolt from the top surface of the pin through the channel of the pin such that a threaded end of the bolt extends from the bottom surface of the pin.

19. The method of claim 18, further comprising:

providing a sleeve member having a flange portion and a cannulated body extending from the flange portion;

prior to inserting the bolt through the channel of the pin, inserting the cannulated body of the sleeve member into the channel of the pin from the bottom surface pin;

wherein inserting the bolt through channel of the pin comprises inserting the bolt through the cannulated body of the sleeve member such that the threaded end extends from the flange portion.

20. The method of claim 19, further comprising:

prior to inserting the bolt through the cannulated body, coupling a washer to the shank portion of the bolt, the washer configured to be housed within a counterbore at the top surface of the pin.

* * * * *